US005890254A

United States Patent [19]

Courtney et al.

[11] Patent Number: 5,890,254

[45] Date of Patent: Apr. 6, 1999

[54] IMPLEMENT WITH E-CLIP HANDLE ATTACHMENT AND HANDLE ALIGNMENT MECHANISM

[75] Inventors: Steven Courtney, Troy; Paul A. Reeder, Worthington; Paul R. Burger, Lebanon, all of Ohio

[73] Assignee: O-Cedar Brands, Inc., Springfield, Ohio

[21] Appl. No.: 931,465

[22] Filed: Sep. 16, 1997

[51] Int. Cl.[6] ..... A46B 15/00; B25G 3/12

[52] U.S. Cl. ..... 15/145; 15/159.1; 15/176.6; 16/114 R; 16/DIG. 40; 403/383

[58] Field of Search ..... 15/143.1, 145, 15/159.1, 176.1–176.6; 16/114 R, DIG. 24, DIG. 40, DIG. 41; 403/256, 261, 379.2, 383

[56] References Cited

U.S. PATENT DOCUMENTS

| | | | |
|---|---|---|---|
| 33,454 | 10/1861 | Pressey et al. | 403/256 X |
| 500,447 | 6/1893 | Walker | 403/256 |
| 812,309 | 2/1906 | Swagerty | 403/13 |
| 846,687 | 3/1907 | McDougall | 403/256 X |
| 939,019 | 11/1909 | Hartwell | 403/379.2 X |
| 1,521,737 | 1/1925 | Washburn | 15/145 |
| 1,920,355 | 8/1933 | Cass | 15/229.1 |
| 2,170,352 | 8/1939 | Schaefer | 403/258 |
| 2,484,401 | 10/1949 | Coie | 403/379.2 X |
| 2,497,384 | 2/1950 | Young | 16/114 A |
| 3,682,516 | 8/1972 | Savage | 403/189 |
| 3,867,943 | 2/1975 | Nordin | 606/180 |
| 4,538,318 | 9/1985 | Lammert et al. | 15/171 |
| 4,541,139 | 9/1985 | Jones et al. | 15/171 |
| 4,642,837 | 2/1987 | Nichols et al. | 15/171 |
| 4,763,377 | 8/1988 | Madsen | 15/144.2 |
| 5,161,278 | 11/1992 | Tomm | 15/159.1 |
| 5,172,447 | 12/1992 | Tomm | 15/159.1 |
| 5,366,314 | 11/1994 | Young | 403/299 |

FOREIGN PATENT DOCUMENTS

| | | | |
|---|---|---|---|
| 339584 | 5/1920 | Germany | 403/256 |
| 243312 | 12/1946 | Switzerland | 16/114 R |

*Primary Examiner*—Mark Spisich
*Attorney, Agent, or Firm*—Biebel & French

[57] ABSTRACT

A hand manipulated implement including an implement head, a handle and a connector rigidly connecting the handle to the implement head. The connector includes a plug which is inserted into the handle and which includes an exposed end for inserting into a collet base defined on the implement head. The connector plug and collet base each include an aperture wherein the apertures of the plug and base are aligned by ribs cooperating with grooves and slots at the lower ends of the plug and collet base. A clip is inserted through the aligned apertures to thereby hold the handle against longitudinal movement relative to the collet base. In addition, a collet is formed at an upper end of the collet base for frictionally engaging the handle and thereby further limiting movement of the handle relative to the implement head.

10 Claims, 5 Drawing Sheets

IMPLEMENT WITH E-CLIP HANDLE ATTACHMENT AND HANDLE ALIGNMENT MECHANISM

BACKGROUND OF THE INVENTION

The present invention is directed to implements, such as brooms and, more particularly, to a connector structure for attaching a handle to an implement head.

The typical upright broom, and in particular push brooms, includes a broom head carrying bristles and a handle attached to the broom head. Generally, the handle is removable and includes a threaded exterior end for engaging a threaded aperture in the broom head. In the past, the broom handle and/or broom head have been formed of wood, and the handle often became loose during usage due to unthreading or due to twisting of the handle relative to the head leading to distortion of the threads.

In an effort to provide an easily assembled handle having a durable connection to the implement head, various connection mechanisms have been proposed. For example, the handle may be formed of a metal or durable material such that the threads on the handle are more resistant to distortion, and the implement head may similarly be provided with threads formed of a durable material. In addition, in order to prevent relative rotation between the handle and the head, collet type locking mechanisms have been proposed wherein a threaded nut is carried on a connector body for causing a resilient portion of the connector to move radially inwardly into frictional engagement with the handle to thereby prevent rotation of the handle.

In a further construction, a non-threaded handle is inserted into a collet attached to an implement head wherein a nut threadably engages the collet to cause the collet to frictionally engage the handle. In addition, the collet and handle have an aperture therethrough wherein a clip is inserted through the aligned apertures to act with the collet to prevent longitudinal and rotational movement of the handle relative to the head. This construction has required increased assembly time in that careful alignment of the apertures relative to each other must be obtained prior to insertion of the clip therethrough. In particular, both the depth of insertion and rotational orientation of the handle within the collet must be carefully controlled inasmuch as the handle is freely rotatable within the collet prior to tightening of the collet and insertion of the clip.

SUMMARY OF THE INVENTION

The present invention provides a hand-manipulated implement, and in particular a broom, which may be easily assembled and which provides an immovable rigid connection between a handle and an implement head.

The connection between the handle and the implement head is defined by a connector portion including a collet base rigidly supported on the implement head and including resilient collet tabs at an upper end thereof, a collet collar for cooperating with the collet tabs to bias the tabs into frictional engagement with the handle, a plug including a portion inserted into the handle and a portion extending downwardly from the handle into an aperture defined in the collet base, and an E-clip including a central prong for extending through aligned radially extending apertures in the collet base and the plug to thereby hold the handle against rotation relative to the implement head.

In addition, the collet base includes a lower end defining a central groove for receiving a central rib defined on the plug, and the collet base further includes a pair of diametrically opposed radially extending ribs for cooperating with grooves on the lower end of the plug. The cooperating lower portions of the plug and collet base provide a means for orienting the aperture of the plug with the radially extending aperture of the collet base, and further provide a means for holding the handle against rotation relative to the implement head. Thus, the plug cooperates with the collet base to facilitate alignment during assembly and thereby reduce assembly time. In addition, the collet, E-clip and cooperating plug and collet base structures form a three way locking mechanism for eliminating relative movement between the handle and the implement head.

Therefore, it is an object of the present invention to provide a connector for attaching a handle to an implement head.

It is a further object of the invention to provide a connector between a handle and implement head wherein a clip is inserted through radially aligned apertures in the handle and head, and means are provided for aligning the apertures.

Other objects and advantages of the invention will be apparent from the following description, the accompanying drawings and the appended claims.

DETAILED DESCRIPTION OF THE PREFERRED EMBODIMENT

Figure 1:
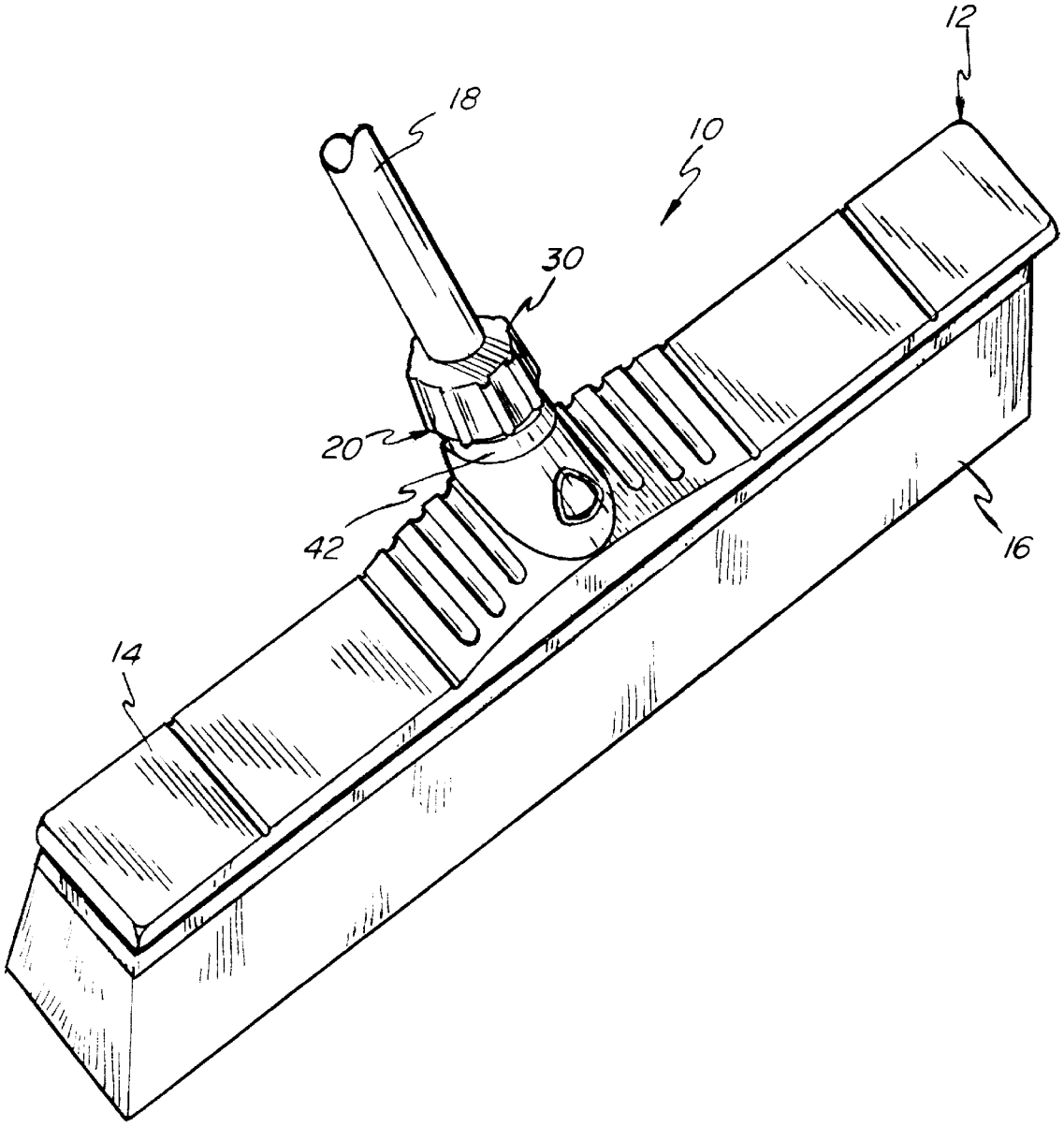
FIG. 1 is a perspective view illustrating a push broom incorporating the present invention.
Figure 2:
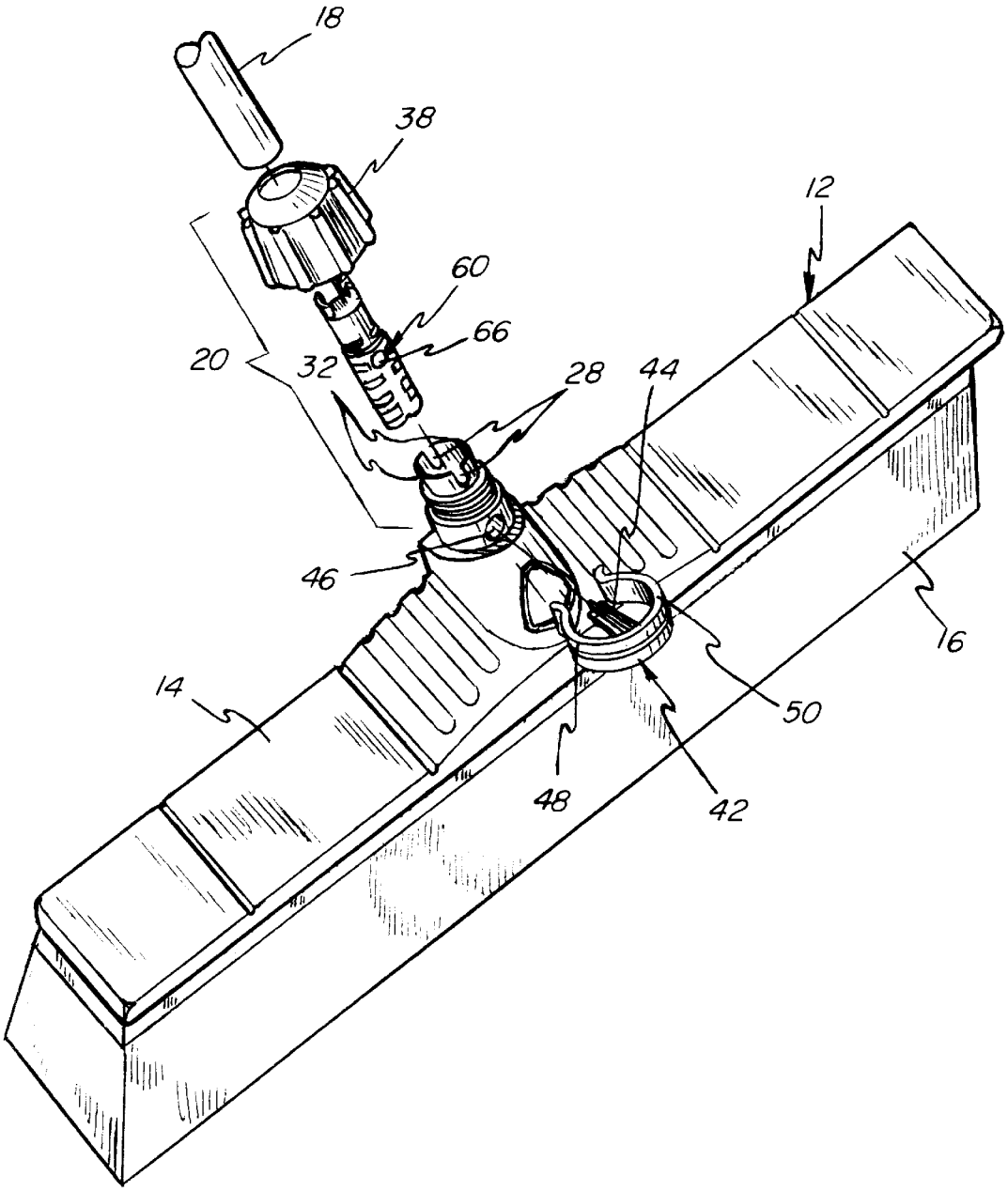
FIG. 2 is an exploded perspective view thereof.

Referring initially to FIGS. 1 and 2, a hand manipulated implement in the form of a push broom 10 is illustrated. The broom 10 includes an implement or broom head 12 having a broom block 14, which is preferably formed of a molded plastics material, and bristles 16 attached to the broom block 14. In addition, the broom 10 includes a handle 18 attached to the broom block 14 by means of a connector 20.

Figure 3:
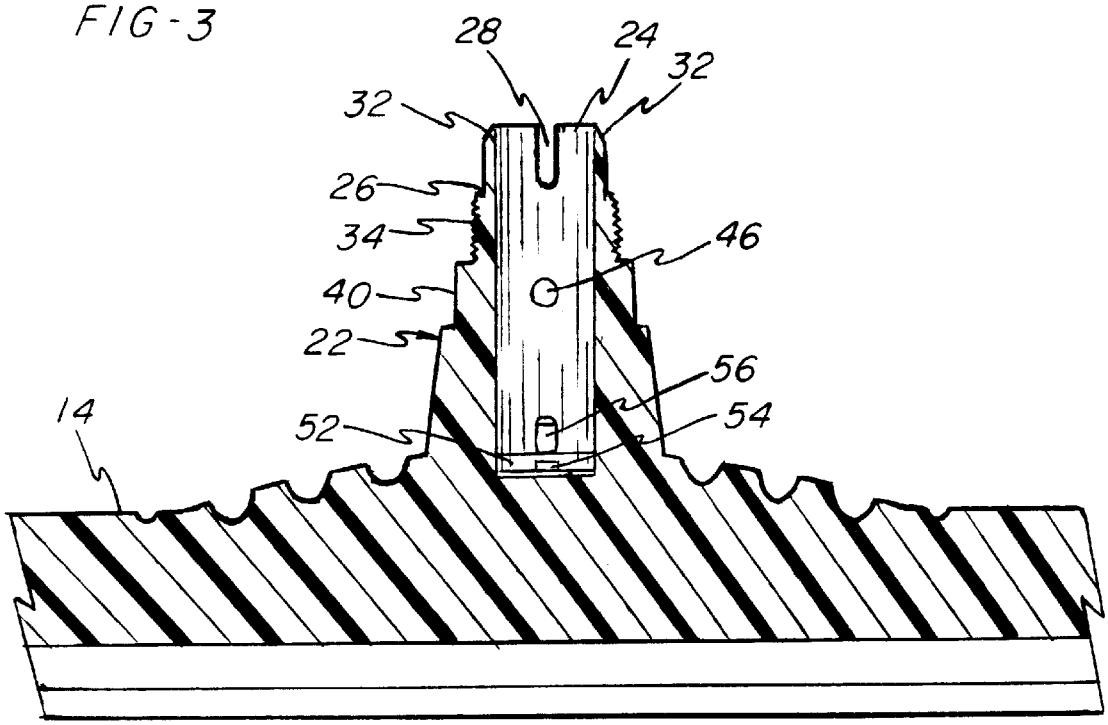
FIG. 3 is a cross-sectional rear elevational view of a central portion of the broom block.
Figure 4:
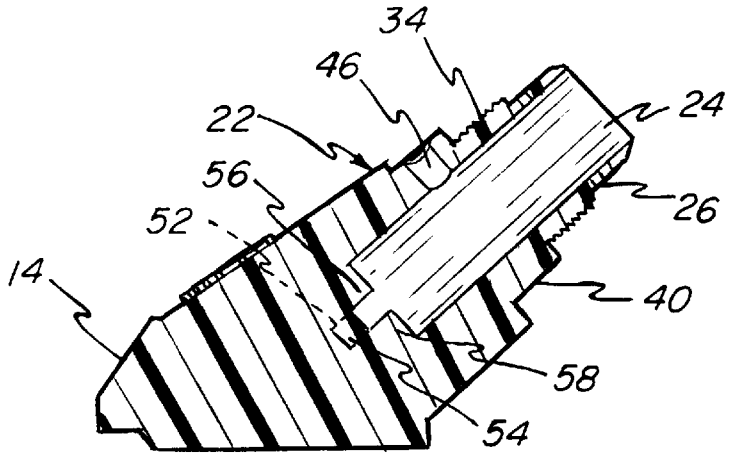
FIG. 4 is a cross-sectional side elevational view of the broom block.
Figure 7:
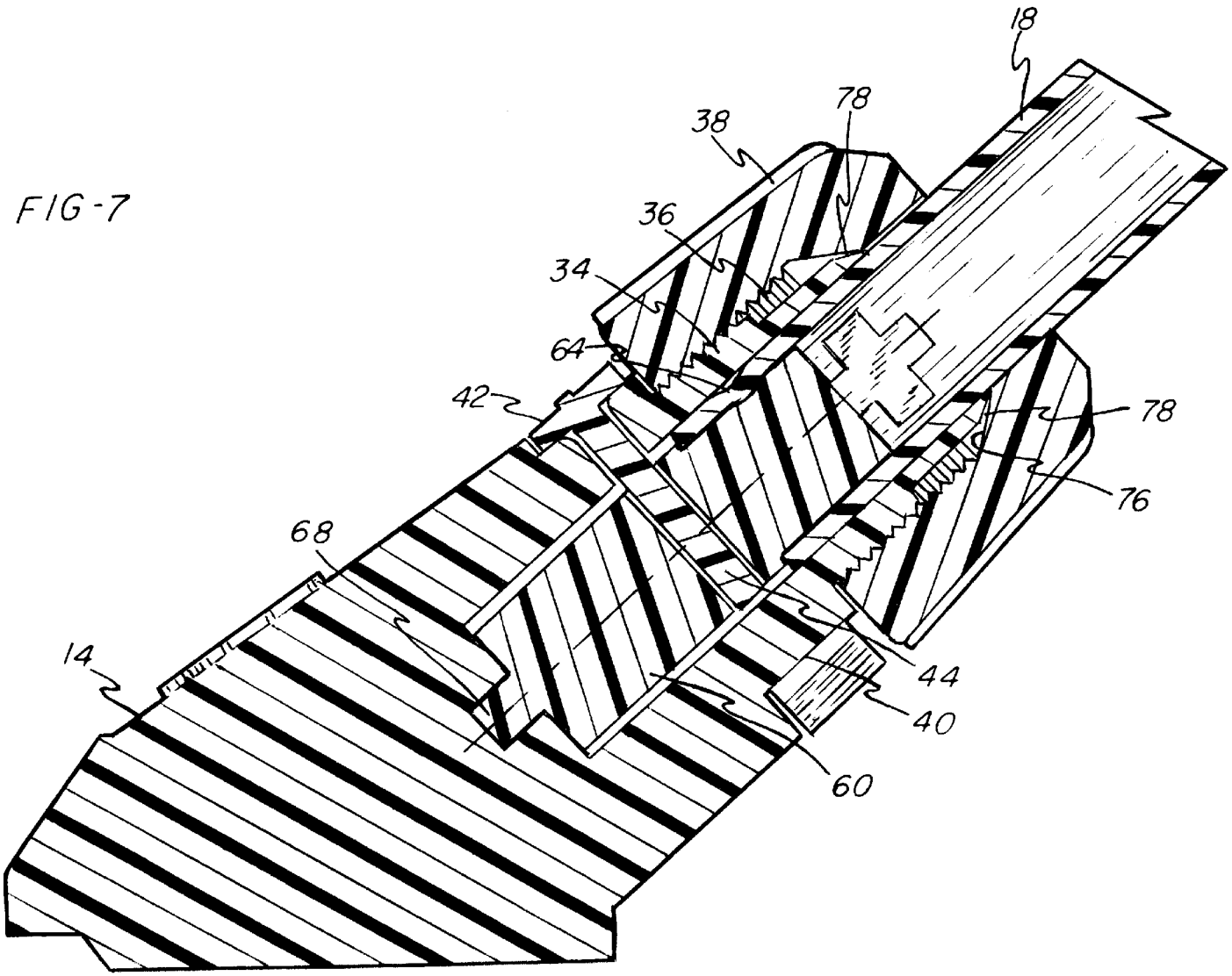
FIG. 7 is a cross-sectional side elevational view of the assembled handle and broom block.

Referring further to FIGS. 3 and 4, the connector 20 includes a collet base 22 molded integrally with the broom block 14. The collet base 22 defines an opening or collet aperture 24 for receiving the handle 18 therein, and a collet 26 is formed at an upper end of the collet base 22. The collet 26 includes a pair of diametrically opposed slots 28 extending longitudinally into the upper end of the collet 26 to define a pair of opposed tabs 32 on the collet 26. The collet 26 further includes a threaded portion 34 on an exterior surface thereof for threadably engaging internal threads 36 (FIG. 7) on a collar 38 for the collet 26.

The collet base 22 further includes a clip support portion 40 located below the threaded portion 34 for receiving an E-clip 42 of the connector 20 (FIG. 2). The E-clip 42 includes an inner prong 44 for engaging a radially extending aperture 46 defined through the clip support portion 40. In addition, the E-clip 42 includes a pair of outer prongs 48, 50 for extending around the clip support portion 40 to thereby hold the E-clip 42 in place on the collet base 22.

As seen in FIGS. 3 and 4, a diametrically extending central groove 52 is defined in the collet base 22 at a lower end of the aperture 24 and includes an upwardly extending tab 54 located at a central portion of the groove 52. In addition, a pair of side ribs 56, 58 extend radially inwardly into the aperture 24 at a location adjacent to an upper end of the groove 52 wherein the ribs 56, 58 extend generally perpendicular to the groove 52. The groove 52, tab 54 and ribs 56, 58 define a lower portion of a locking structure for holding the handle 18 in place, as described further below.

Figure 5:
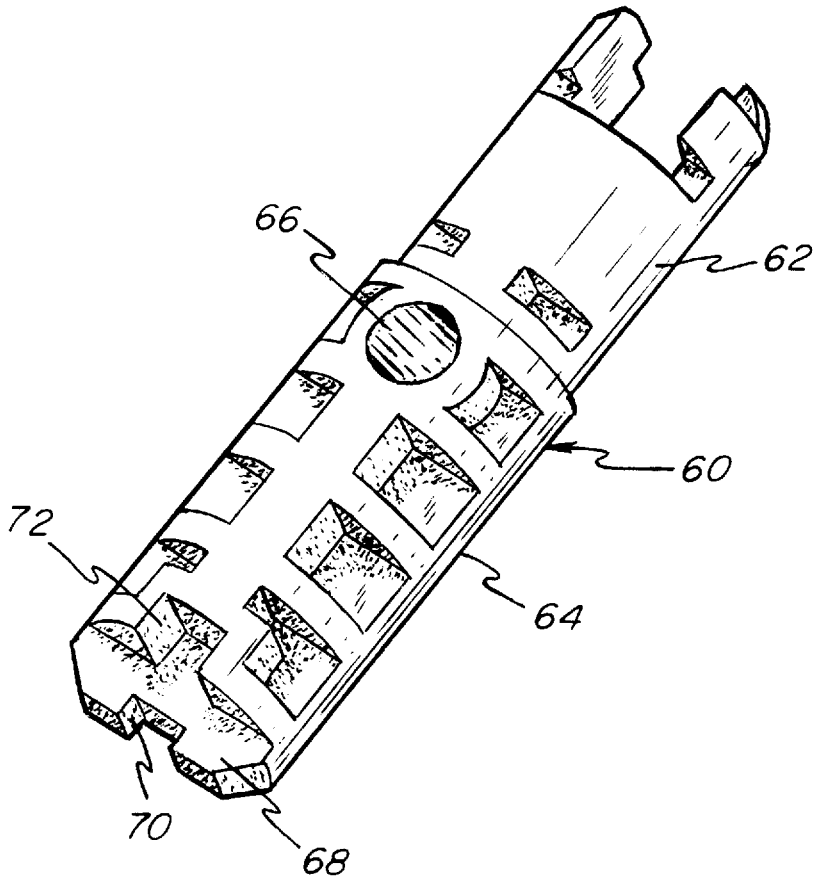
FIG. 5 is a perspective view of a plug for connecting the handle to the broom block.
Figure 6:
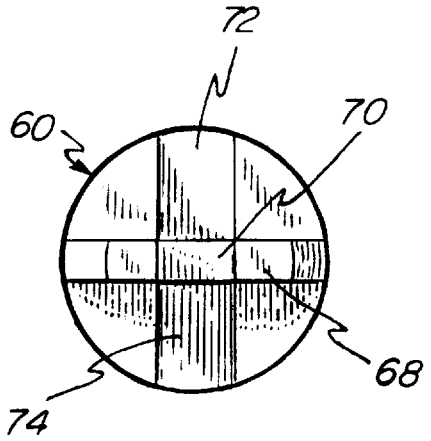
FIG. 6 is a bottom end view thereof.

Referring to FIGS. 5 and 6, the connector 20 further includes a plug 60 formed of a molded plastics material and having a first section 62 which is adapted to be inserted into the hollow lower end of the handle 18. The handle 18 is preferably formed of a tubular metal material and may be crimped onto the first section 62 of the plug 60 as illustrated at 64 (FIG. 7) to thereby rigidly attach the handle 18 and plug 60 together as a handle assembly.

The plug 60 further includes a second section 64 of a larger diameter than the first section 62 wherein the second section 64 is adapted to be inserted into the collet aperture 24 and includes a radially extending aperture 66 for alignment with the aperture 46 in the clip support portion 40 to receive the central prong 44 of the E-clip 42. The second section 64 further includes an upper portion of a locking structure which is adapted to cooperate with the lower portion of the locking structure in the collet base 22 for positioning the plug 60 to angularly align the aperture 66 with the aperture 46, and to prevent the plug 60 from rotating within the collet aperture 24. The upper locking structure portion comprises a central rib 68 for engaging the central groove 52 in the collet base 22, and a notch 70 defined in the central rib 68 for engaging around the tab 54. In addition, side grooves 72, 74 are provided for cooperating with the side ribs 56, 58. Thus, as the handle 18 and associated plug 60 are inserted into the collet aperture 24, they may be moved downwardly until the central rib 68 reaches the location of the side ribs 56, 58 within the collet base 22. The handle may be freely rotated within the collet aperture 24 until the central rib 68 is aligned perpendicular to the inward extension of the side ribs 56, 58, at which time the plug 60 will seat downwardly to position the central rib 68 in non-rotatable engagement with the central groove 52, and the ribs 56, 58 in seated engagement with the grooves 72, 74 of the plug 60. Thus, the positioning of the plug 60 within the aperture 24 simultaneously aligns the plug aperture 66 with the collet base aperture 46 and locks the plug 60 against rotation within the aperture 24.

When the handle 18 and plug 60 have been positioned into the collet aperture 24, the E-clip 42 is pressed into position with the central prong 44 extending through the apertures 46 and 66 and with the outer prongs 48, 50 resiliently pressed into surrounding engagement on the clip support portion 40. In addition, the collar 38 is brought into threaded engagement with the threaded portion 34 of the collet base 22 whereby an angled inner portion 76 of the collar is brought into engagement with tapered surfaces 78 on the tabs 32 to thereby press the tabs 32 into firm frictional engagement with the outer surface of the handle 18.

Thus, the present connector structure provides a three way lock for preventing movement of the handle 18 relative to the broom block 14 including the lower section 64 of the plug 60 cooperating with the lower portion of the collet aperture 24, the E-clip 42 engaging through the apertures 46 and 66 of the collet block 22 and plug 60, respectively, and the collet including the collar 38 cooperating with the tabs 32 to frictionally grip the handle 18. In this manner, the connector 20 provides a firm connection between the handle 18 and broom block 14 which prevents removal of the handle 18 and ensures that relative movement at the connection between the handle 18 and the broom block 14 is effectively prevented.

Further, it can be seen that the present invention provides a convenient means for facilitating assembly of a handle to a broom block. Specifically, the present invention provides cooperating rib and groove structures to facilitate orientation of the respective apertures in the connector plug 60 and collet base 22 whereby the E-clip 42 may be readily inserted during assembly.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A hand manipulated implement comprising:

an implement head;

a handle assembly;

a connector rigidly attached to said implement head and extending upwardly therefrom, said connector defining an opening for receiving an end of said handle assembly;

a first aperture extending through said connector;

a second aperture extending through said handle assembly;

a clip having a prong for extending through said first and second apertures;

an upper locking structure extending across an end surface of said handle assembly;

a lower locking structure located at a bottom portion of said connector for engaging said upper locking structure; and wherein said handle assembly is freely rotatable within said connector during an assembly operation of attaching said handle assembly to said implement head, and said upper locking structure is operable to cooperate with said lower locking structure during insertion of said handle assembly into said connector whereby said first aperture is angularly aligned with said second aperture to facilitate insertion of said clip through said first and second apertures.

2. The implement of claim 1 wherein said upper and lower locking structures comprise cooperating rib and groove structures.

3. The implement of claim 1 wherein said upper locking structure comprises a diametrically extending central rib and a pair of side grooves located on either side of said central rib, and said lower locking structure comprises a central groove for receiving said central rib and a pair of ribs extending radially inwardly for engaging said pair of side grooves.

4. The implement of claim 1 wherein said handle assembly comprises a hollow handle and a plug inserted in a lower end of said handle, and said upper locking structure is defined on said plug.

5. The implement of claim 1 wherein said connector comprises a collet including a plurality of slots extending longitudinally into an end of said connector to define flexible tab portions for frictionally engaging said handle assembly.

6. The implement of claim 5 including a collar positioned over said collet and including an interior surface in engagement with said flexible tab portions for biasing said tab portions radially inwardly toward engagement with said handle assembly.

7. The implement of claim 5 wherein said clip comprises an E-clip having two outer prongs for positioning along sides of said collet and an inner prong for extending through said first and second apertures.

8. A broom comprising:

a broom head;

a handle assembly;

a collet base rigidly attached to said broom head and including a collet extending upwardly therefrom, said collet base defining an opening for receiving an end of said handle assembly;

a threaded portion defined on an external surface of said collet base;

a plurality of slots extending longitudinally into an end of said collet base adjacent to said threaded portion to define end tabs on said collet;

tapered exterior surfaces located at said end tabs;

a collar having an interior surface and a threaded portion defined on said interior surface and threadably engaged with said threaded portion on said collet base, said interior surface contacting said tapered exterior surfaces on said end tabs such that longitudinal movement of said collar along said collet causes said end tabs to move radially inwardly into frictional engagement with said end of said handle assembly;

a first radially extending aperture extending through said collet base;

a second radially extending aperture extending through said handle assembly;

an E-clip having two outer prongs for positioning along sides of said collet base and an inner prong for extending through said first and second apertures;

a central rib extending diametrically across an end surface of said handle assembly;

a central groove located at a bottom portion of said collet base for engaging said central rib; and wherein said handle assembly is freely rotatable within said collet base during an assembly operation of attaching said handle assembly to said broom head, and said central rib is operable to cooperate with said central groove during insertion of said handle assembly into said collet base whereby said first aperture is angularly aligned with said second aperture to facilitate insertion of said E-clip through said first and second apertures.

9. The implement of claim 8 including a pair of side grooves located on said handle assembly on either side of said central rib, and a pair of ribs extending radially inwardly within said collet base for engaging said side grooves.

10. The implement of claim 8 wherein said handle assembly comprises a hollow handle and a plug inserted in a lower end of said handle, and said central rib is defined on said plug.

* * * * *